United States Patent [19]

Johnson

[11] 4,146,998

[45] Apr. 3, 1979

[54] POSITION RESPONSIVE VALVE FOR CONTROLLING THE RETRACTION RATE OF A LOWER BOOM IN AN ARTICULATED BOOM ASSEMBLY

[75] Inventor: Leonard L. Johnson, Fort Wayne, Ind.

[73] Assignee: TECO, Inc., Fort Wayne, Ind.

[21] Appl. No.: 769,120

[22] Filed: Feb. 16, 1977

[51] Int. Cl.[2] ..... E04H 12/34

[52] U.S. Cl. ..... 52/115; 52/119; 182/2; 137/38; 212/39 A

[58] Field of Search ..... 182/2, 19; 137/38; 212/39 R, 39 MS, 39 A, 69; 91/419; 52/115, 117

[56] References Cited

U.S. PATENT DOCUMENTS

| | | | |
|---|---|---|---|
| 2,182,463 | 12/1939 | Beeston | 137/38 |
| 3,371,800 | 3/1968 | Grove | 212/39 R |
| 3,415,021 | 12/1968 | Myers | 137/38 |
| 3,670,849 | 6/1972 | Milmer | 182/19 |
| 4,037,742 | 7/1977 | Gustafsson | 212/93 MS |

FOREIGN PATENT DOCUMENTS

| | | | |
|---|---|---|---|
| 2059460 | 6/1971 | Fed. Rep. of Germany | 91/419 |

*Primary Examiner*—Ernest R. Purser
*Assistant Examiner*—Henry Raduazo
*Attorney, Agent, or Firm*—John A. Young

[57] ABSTRACT

In an articulated boom having a platform and comprised of upper and lower booms respectively, there are hydraulic actuators controlling the movements of the upper and lower booms. Control means are necessary in association with the lower boom to control its rate of movement, slowing such rate of movement as the lower boom approaches its retracted, or full rest, position. A position responsive valve permits unimpeded fluid pressure access to the actuator for lowering the lower boom at its regular rate until the lower boom reaches a critical angle as it approaches horizontal position, at which time the valve prevents further fluid access to its associated hydraulic actuator. Thereafter, a position responsive valve and a pressure reducing valve reduce the rate of descent of the lower boom until the lower boom is fully retracted to its rest position.

The described hydraulic control is in a single package which can be retrofitted into existing hydraulic systems and is independent of the pilot operated check valve and cylinder, being located between the main control valve and the power cylinder and does not interfere with existing hydraulic controls.

6 Claims, 5 Drawing Figures

FIGURE 2
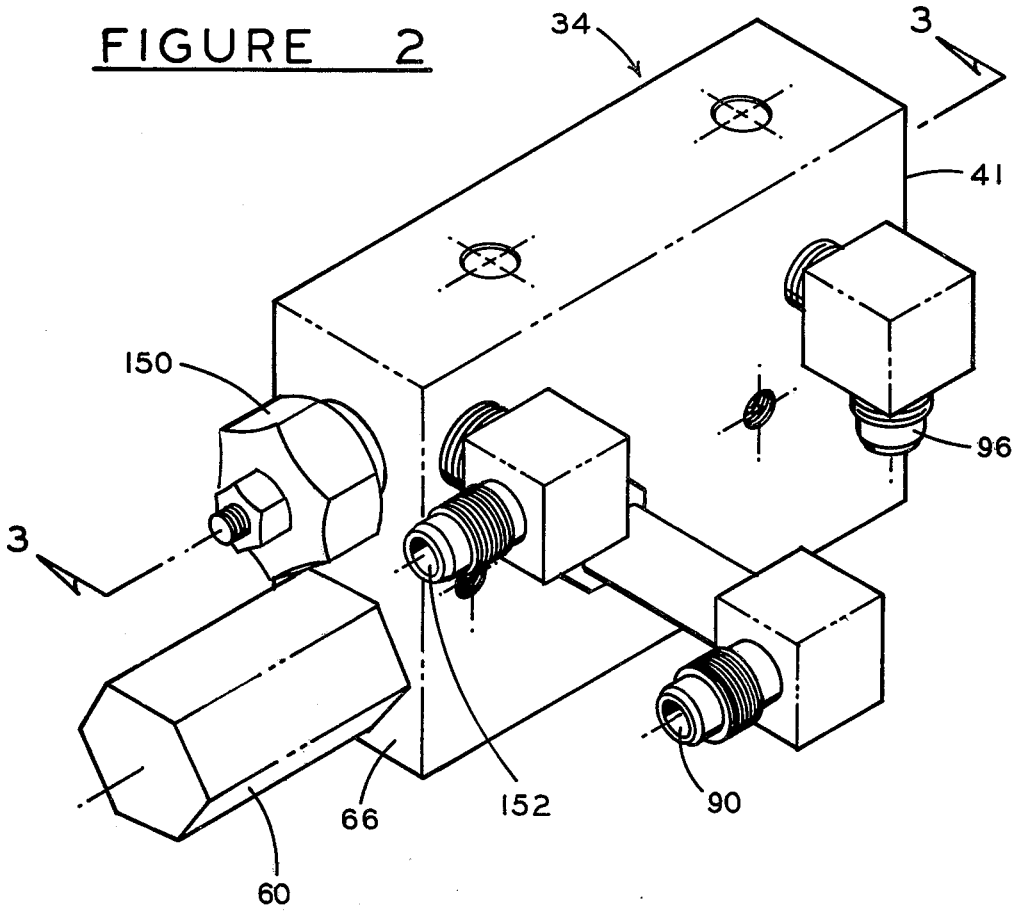
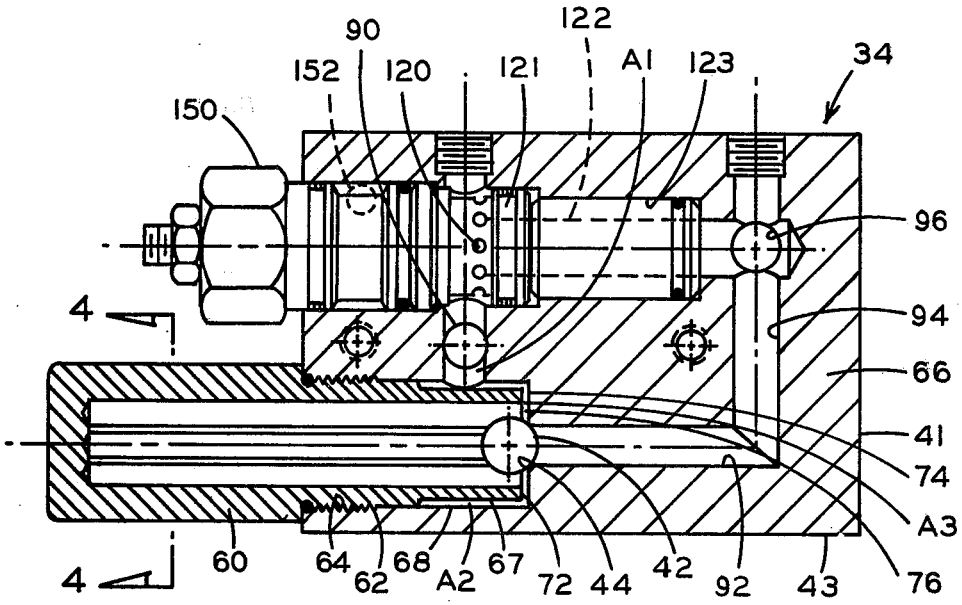
FIGURE 3

POSITION RESPONSIVE VALVE FOR CONTROLLING THE RETRACTION RATE OF A LOWER BOOM IN AN ARTICULATED BOOM ASSEMBLY

BACKGROUND OF THE INVENTION

In mobile units having articulated booms with a movable lift platform at the end of the upper boom, there has been some considerable difficulty in fitting the unit with a device which will cushion movement of the lower boom into its final rested position. Moreover, in the hydraulic devices presently being used, because there is a positive retracting force exerted on the lower boom the retracting device can at times be destructive as it tends to draw positively upon the lower boom, pulling it with destructive force against the final resting place for the boom in preparation for transport.

Hydraulic devices have been proposed for incorporation into the hydraulic systems of units to effect more controlled positive retracting force on the lower boom. These devices are for the most part used in conjunction with the pilot operated check valve and cylinder, and therefore interrupt the normal operation of the hydraulic device. Such devices must be "built into" the hydraulic system at the time of its initial manufacture in order to produce an integrated system.

What the present invention proposes is a much simpler and more reliable system for controlling the actuation of the fluid motor (power cylinder) associated with the lower boom, the unit being inserted between the main control valve and the fluid motor. There is no interference with the pilot operated check valve and consequently the inserted unit is made up of hydraulic "package" which can be retrofitted into existing hydraulic systems having motors or power cylinders for retracting the lower boom. The present system will operate to accomplish its intended purpose but in no way will interfere with normal operation of the power cylinder for the lower boom. The device or unit imposes upon the operation of the hydraulic cylinder the special condition that as the lower boom approaches horizontal positions, it will, at a critical angle, cause normal hydraulic application to cease, and thereafter retracting force will be diminished and a much reduced pressure will be effective for operating the lower boom from the critical angle thereafter to the full horizontal stored position for transit.

OBJECTS OF THE INVENTION

It is an important object of the present invention to provide a hydraulic control in a modular form which can be retrofitted into existing hydraulic systems which are useable in operating articulated booms having lift platforms.

It is an important object of the present invention that such a hydraulic system as proposed by the present invention will in no way interfere with the normal operation of the hydraulic system now in use on such systems and can be readily fitted between the main control valve and the power cylinder associated with the lower boom without interfering with the pilot operated check valve associated with the power cylinder.

It is an important object of the present invention to provide a hydraulic control system in which the lower boom will operate in the usual manner until it reaches a critical angle at which the lower boom is in nearly horizontal position and thereafter operation of the power cylinder will continue, but under much reduced hydraulic pressure conditions in the interval between such critical angle and the full retracted position for the lower boom as it is brought into its nested or transport position.

An important feature of the present invention is that previous shortcomings of hydraulic systems such as ones which cause inadvertent damage to the boom and vehicle by "pulling" the lower boom into retracted position with excessive force, even after it is fully retracted, to damage the boom, vehicle, or both, are effectively precluded by means of the present invention.

Other objects and features of the present invention will become apparent from a consideration of the following description which proceeds with reference to the accompanying drawings.

DRAWINGS

FIG. 2 is an isometric view of the hydraulic device which is incorporated into the existing hydraulic system intended for control and operation of lift cylinder associated with the lower boom of a pair of articulated booms;

FIG. 3 is a section view taken on Line 3—3 of FIG. 2;

DETAILED DESCRIPTION OF THE INVENTION

Figure 1:
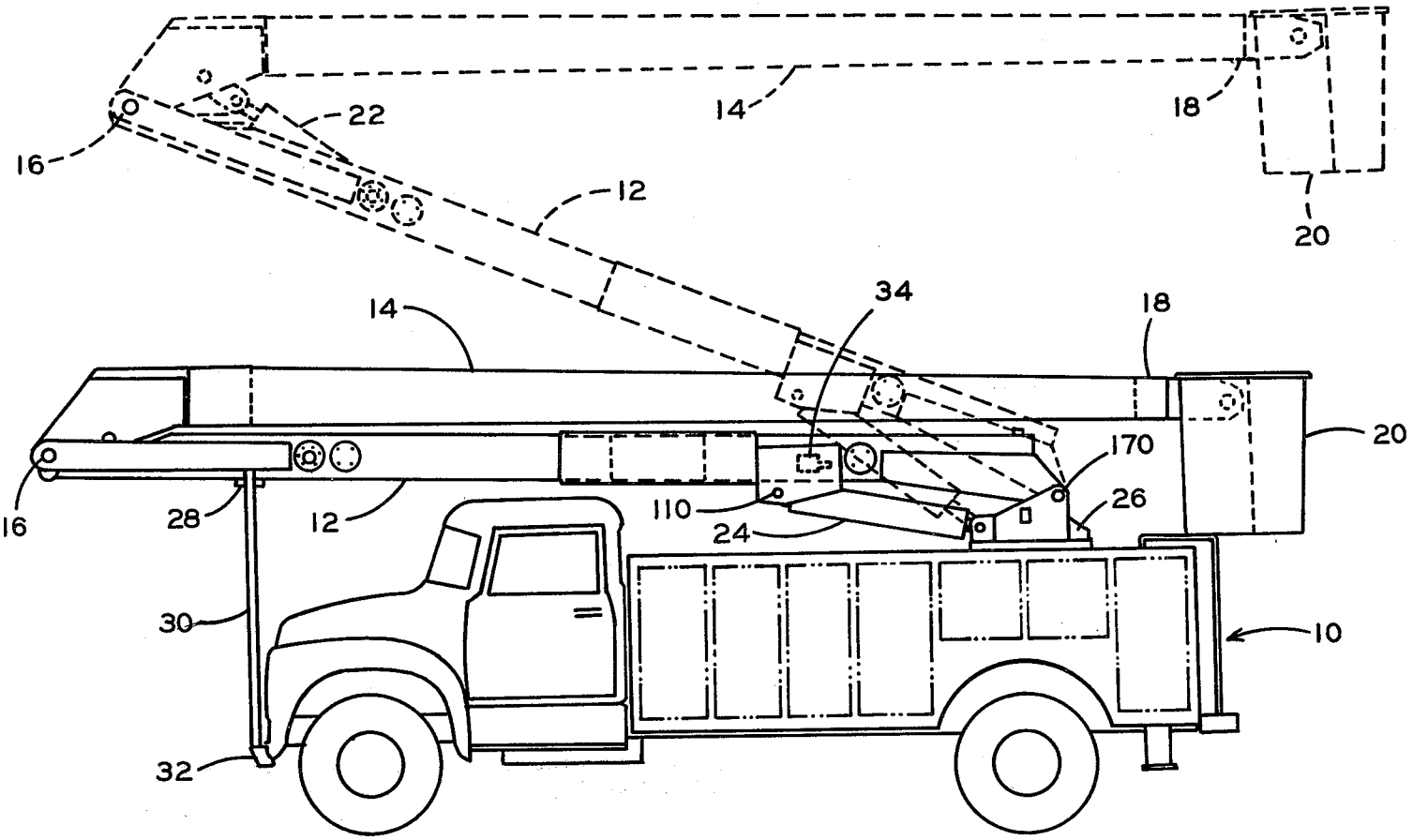
FIG. 1 is a side elevation view of a vehicle having an articulated boom shown at full retracted position in full line, and the boom partially extended, as shown in dotted lines.

Referring now to FIG. 1, a vehicle designated generally by reference numeral 10 has a pair of articulated booms 12 and 14 which are pivotally joined together at elbow 16, the upper boom 14 having at its extended or free end 18 a basket 20 for an occupant.

The two booms are operated by a pair of hydraulic power cylinders, one, 22, located at elbow 16, and the other, 24, located at the base or turntable 26.

The operator has available to him within the basekt, means for operating each of the cylinders 22,24 as well as a hydraulic power cylinder or hydraulic motor (not shown) associated with turntable 26 in order to locate the basket 20 at the preferred working position.

Details of the construction and methods for operating the hydraulic cylinders as well as details of the hydraulic system as a whole and disclosed in my co-pending applications: application Ser. No. 720,569, filed: Sept. 7, 1976, titled: IMPROVED FLUID CONTROL SYSTEM, Inventor: Leonard L. Johnson, Assignee: Teco, Inc; application Ser. No. 746,661, filed: Dec. 2, 1976, titled: IMPROVED ACTUATOR FOR HYDRAULIC SYSTEMS IN TRANSPORTABLE MOBILE PLATFORMS, Inventor: Leonard L. Johnson, Assignee: Teco, Inc.; application Ser. No. 761,730, filed: Jan. 24, 1977, titled: HYDRAULIC DEVICE FOR CONTROLLING THE PERPENDICULARITY OF BOOM MEMBERS IN MOBILE PLATFORMS, Inventor: Leonard L. Johnson, Assignee: Teco, Inc.

The present invention is concerned primarily with a control for the power cylinder 24, and more specifically with controlling the power cylinder 24 as it moves the lower boom 12 into the fully retracted position shown in FIG. 1. The principal problem in the past has been how to sense the final increment of movement of the lower boom 12 from a critical near-horizontal position to a full horizontal position wherein the lower boom 12 comes into contact with a U-shaped support 28 at the end of post 30 secured to the front end 32 of the vehicle.

It has frequently happened in the past that the hydraulic cylinder 24 forcibly engages the boom 12 against 28, and does so with continuing and considerable force, producing distortion and at times damage to both support 28 and boom 12.

The purpose of the present invention is, by means of a hydraulic control 34 (FIG. 2,3) interposed between the lower boom control valve 36 (FIG. 5) and power cylinder 24, to sense a critical angle at which the lower boom approaches horizontal position, and will thereafter prevent unrestricted fluid pressure from the lower boom control 36 to the power cylinder 24 and instead, will permit only a greatly restricted fluid pressure to be communicated to the piston rod side of the power cylinder (FIG. 5) to reduce substantially the rate of lowering movement of the lower boom 12 as it continues thereafter to move into full retracted position in coming into engagement with the support 28 at the end of upright 30. At this point the lower boom 12 is in its fully retracted, transport position.

Hydraulic device 34 is arranged so that end 41 (FIG. 3) is mounted on the lower boom 12 positioned toward the elbow 16 so that when the lower boom is in any inclined position to the horizontal, surface 43 of the device is also inclined upwardly. Within hydraulic control device 34 is a gravity responsive ball 42 which, whenever the lower boom 12 is elevated angularly, is rotated away from seating relation with ball seat 44, the ball 42 being received within a passage 46 (FIG. 4) having arcuate circumferentially spaced segments 48 which provide bearing surfaces for the ball 42. Also surrounding the ball, are part circular enlargements 50 which permit hydraulic fluid to be on both sides of the ball at all times except when the ball 42 is seated.

The passage 46 is formed within an elongated sleeve 60 which is externally threaded at 62 for threadedly joining with an opening 64 in valve body 66. The sleeve has a reduced diameter section 67 which provides an annular passage 68 relative to opening 64 and end 72 terminates short of 74 to leave a gap or space 76.

Figure 5:
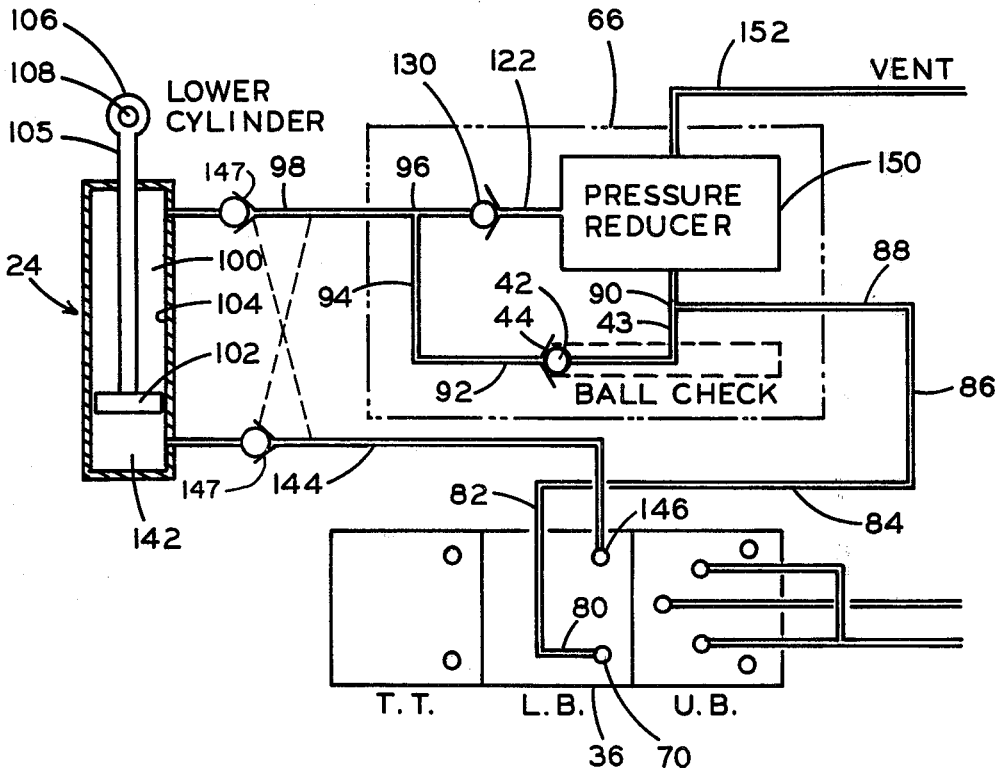
FIG. 5 is a schematic view illustrating the hydraulic system which controls the connections between the main hydraulic fluid pressure source and the lift cylinder associated with the lower boom.

Referring to FIGS. 3 and 5, hydraulic fluid, under pressure from a pump or the like, is tramsmitted from port 70 or the lower boom control 36, to inlet line 80, through lines 82, 84, 86, and 88 to port 90, past ball seat 44 should the ball 42 be unseated. Fluid pressure is next transmitted through longitudinal passages 92 and 94 in valve body 66 to outlet port 96 and line 98 which terminates at inlet port 100 of power cylinder 24 where it acts against a piston 102 slideably received in cylinder bore 104. This results in the piston rod 105 being drawn downwardly. End 106 of piston rod has an opening 108 connecting through a pin 110 with lower boom 12 also drawing it downwardly.

As lower boom 12 approaches a horizontal position, ball 42 is caused to roll under gravity along passage 46 until it engages ball seat 44 and closes the outlet to passage 92, et seq., and thereby preventing further communication with lift cylinder through passages 92,94, port 96, conduit 98 and inlet port 100. Thereafter, fluid pressure from the lower control valve 36 is communicated to hydraulic control 34 through port 90, radial passages 120 of spool 121 in bore 123, connecting with a longitudinal passage 122 to outlet port 96 and in the process of so doing the pressure is materially reduced to a constant lower pressure regardless of fluctuation in pressure inletting to the device 34 through inlet port 90. When the pressure in passage 92 is reduced to zero, the pressure developed in passage 122 (FIG. 5) causes the check valve 130 to become unseated and reduced pressure is communicated past check valve 130, line 98, and inlet port 100 to cylinder bore 104 causing the piston 102 to be displaced downwardly at a much reduced pressure.

Figure 4:
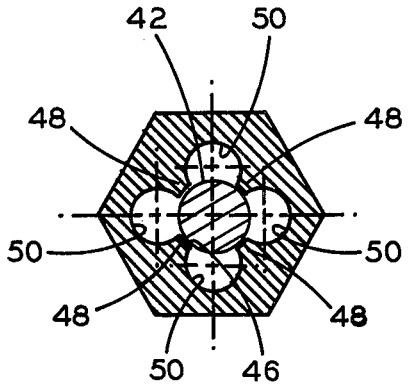
FIG. 4 is a section view taken on Line 4—4 of FIG. 3.

Hydraulic fluid within exhausting chamber 142 is displaced through conduit 144 and port 146 of the lower boom control valve 36 to reservoir (not shown). Referring to FIG. 5, conduit 98 and conduit 144, each includes a check valve 147 and each ball check valve 147 is communicated through cross line in 144 and 98 to unseat the valves, as shown in FIG. 4 of application Ser. No. 761,730, referenced herein before.

The reduced pressure, effected by reducing valve 150, is maintained by virtue of an outlet opening 152 which communicates with reservoir. In other words, excess hydraulic fluid pressure and fluid flow, which would otherwise cause the reduced pressure to build up, is bypassed through port 152 (FIG. 3) to reservoir.

Referring to FIG. 3, area A-1 is the cross-section of the passage of the inlet passage 90 to the control valve 34, the area A-2 is the annular area provided between bore 70 and the reduced diameter end 67; and, area A-3 is defined by the area circumscribed by the end 74 of the sleeve 60. These areas are all the same; that is, A-1 equals A-2 equals A-3, so that there is no fluid pressure tending to move the ball 42 in either direction. The ball 42 is therefore position responsive solely as a matter of gravity. It is the horizontal position of the lower boom 12 to which the device 34 is attached, that solely determines the position of the ball 42 and no other factor.

The control valve 34 before being modified by addition of the position responsive valve, is obtainable from the Sun Company, Model No. PPFA and PPFB, having a pilot flow of 10–15 $in^3$/min. and 1200 psi maximum inlet pressure. The device is shown in Catalog No. 1101/8–75 entitled "Sun Hydraulics Corporation".

OPERATION

In operation, referring to FIG. 1, while the articulated boom consisting of lower boom 12 and upper boom 14 is being retracted, the lower boom 12 is caused to pivot from an inclined to a horizontal position about pivot 170 by means of power cylinder 24. Attached to the lower boom 12 is control 34.

Lower boom 12 operates in its normal fashion, that is, fluid pressure from any suitable source is communicated (FIG. 5) from lower boom control valve 36 to inlet port 70, through passages 80,82,84,86,88, port 90, past ball seat 44 which is uncovered by the ball 42, through drilled passages 92,94 of valve body to outlet port 96, passage 98, inlet port 100, cylinder bore 104 displacing the piston 102 and piston rod 105, thereby drawing the lower boom 12 downwardly.

When the lower boom 12 comes to a critical predetermined angle approaching horizontal position, the ball 42 under gravity, rolls on bearing surfaces 48 (FIG. 4) into a position closing ball seat port 44. When the lower boom 12 reaches its critical position, the ball 42 (entirely gravity responsive and in no way affected by fluid pressure) closes passage 92 against further hydraulic fluid flow and thereafter, fluid from inlet port 90 must flow through radial orifices 120, central passage 122 past now opened check valve 130, and outlet port 96, line 98, inlet port 100, to cylinder bore 104, so that piston 102 is actuated under a much reduced order of fluid pressure in the final increment of angular downward movement of boom 12 from the critical angle to its full retracted position where it is brought against surface 28 of post 30.

While fluid is metered through the reducing valve, fluid is also continuously transmitted to reservoir through the reservoir opening 152 in order that reduced pressure of constant value will be maintained at the assigned value and communicated to cylinder box 104.

During retraction of the lower boom 12, fluid is exhausted from chamber 142 through passage 144 and port 146 in the lower boom control (FIG. 4) to reservoir (not shown).

When it is desired to raise the lower boom 12, fluid pressure is communicated through the lower boom control 36 (FIG. 5) commencing with port 146, line 144, to chamber 142, raising the boom 12 and fluid is exhausted from cylinder bore or chamber 104 through line 98, port 96, passage 94 (FIG. 5), unseating ball 42, passage 43 through port 90, hydraulic lines 88, 86, 84, 82, 80, and port 70, to exhaust.

Thus, the hydraulic device 34 in no way interferes with raising of the lower boom 12. The hydraulic device 34 can be readily fitted into any existing hudraulic system, being interposed as it is between the power cylinder 24 and the control 36 already provided for the lower boom and upper boom as indicated in FIG. 5. The inclusion of the device 34 does not in any way interfere with the check valves which are in direct proximity and in combination with the power cylinder 24.

Once the unit 34 is in place, it will operate continuously and automatically without any interference with the existing hydraulic system to effect a dampening or reduction in rate of lowering movement of the lower boom during its final increment of travel into nested or traveling position.

The valve is an inexpensive valve and is readily retrofitted into existing hydraulic systems which are used for controlling the articulated booms of mobile lift platforms.

Although the present invention has been illustrated and described in connection with a single example embodiment, it will be understood that this is illustrative of the invention and is by no means restrictive thereof. It is reasonably to be expected that those skilled in this art could make numerous revisions and adaptations of the invention and it is intended that such revisions and adaptations will be included within the scope of the following claims.

What is claimed is:

1. In an upper and lower boom mobile lift platform system, a combination of fluid motor actuators adapted to effect angular movement of said upper boom and lower booms respectively, and control means associated with the fluid motor actuator for said lower boom and effective for controling its angular downward movement into retracted position and consisting of a regulating means effective as the lower boom approaches its terminal downward movement into retracted position to develop a predetermined reduced pressure and accompanying fluid flow, a first valve means including a hydraulic line for controlling fluid pressure to the lift piston of said fluid motor actuator associated with the lower boom to effect its angular movement in a raising direction, a second valve means adapted to communicate fluid pressure to the lift piston in said fluid motor actuator and thereby effecting actuation of said lower boom in a lowering direction, and gravity responsive means for making effective or ineffective said regulating means responsively to the angular position of said lower boom whereby said lower boom in predetermined critical angular positions approaching horizontal position effects a throttling action to reduce pressure communicable to the piston of said hydraulic actuator association with said lower boom to effect a diminished rate of lowering movement of said lower boom in the terminal angular increment just preceding movement of the lower boom into its full retracted position.

2. The apparatus in accordance with claim 1 including a pressure-reducing valve which is operative to control the fluid pressure at a much reduced constant value to said lower boom fluid motor actuator when said ball check valve is gravitally actuated to closed position.

3. The control means in accordance with claim 1 which includes an elongated opening and a ball moveable therein, longitudinally extending lateral enlargements of said opening which provide flow-by at all unseated positions of said ball and adapted to provide hydraulic flow past said ball check valve while maintaining a bearing surface for said ball, and a port controlled by said ball which moves between sealing position and unsealing position relatively to said port and thereby to effect the rate of operation of the fluid motor actuator controlling said lower boom from a predetermined near-horizontal position to fully retracted or rested position on the vehicle.

4. The hydraulic control system in accordance with claim 1, including a pressure reducing valve which is effective to prevent the counterflow passage of fluid through said pressure reducer, and a check valve which is downstream of said pressure reducing valve.

5. A process for controlling lower boom retraction in an articulated boom system at the terminal part of the lower boom retractile stroke in order to cushion the movement of the lower boom into full nested or transport position, comprising the steps of: freely communicating fluid pressure from a fluid pressure source to a fluid motor actuator effecting a downward movement of the lower boom to its retractile position, terminating direct fluid flow to said fluid motor actuator at a critical position of said lower boom approaching its horizontal position and thereafter communicating fluid pressure to said fluid motor actuator through a pressure reducer which greatly reduces and limits the rate of actuation of said fluid motor actuator producing retractile lower boom movement in the increment between said critical near-horizontal position of the lower boom and its fully retracted position.

6. The process in accordance with claim 5 including the step of limiting the flow of fluid through a pressure reducing means to the fluid motor actuator to provide a low magnitude pressure-producing activation of said fluid motor but at a constant pressure regardless of the fluctuations in input pressure to said pressure reducing means.

* * * * *